US010385650B2

(12) United States Patent
Saulou et al.

(10) Patent No.: US 10,385,650 B2
(45) Date of Patent: Aug. 20, 2019

(54) FRAC PLUG APPARATUS, SETTING TOOL, AND METHOD

(71) Applicant: MAVERICK DOWNHOLE TECHNOLOGIES INC., Edmonton (CA)

(72) Inventors: Cory Saulou, Edmonton (CA); Tim Stewart, Edmonton (CA)

(73) Assignee: MAVERICK DOWNHOLE TECHNOLOGIES INC., Edmonton, Alberta ( * ) Notice: Subject to any disclaimer, the term of this patent is extended or adjusted under 35 U.S.C. 154(b) by 276 days.

(21) Appl. No.: 15/352,415

(22) Filed: Nov. 15, 2016

(65) Prior Publication Data

US 2018/0135380 A1 May 17, 2018

(51) Int. Cl.
*E21B 23/01* (2006.01)
*E21B 43/26* (2006.01)
*E21B 33/128* (2006.01)

(52) U.S. Cl.
CPC ..... *E21B 33/128* (2013.01)

(58) Field of Classification Search
CPC ..... E21B 33/1293; E21B 23/01; E21B 43/26; E21B 33/129
See application file for complete search history.

(56) References Cited

U.S. PATENT DOCUMENTS 3,253,653 A * 5/1966 Layne, Sr. ..... E21B 23/04 102/313
8,215,386 B2 * 7/2012 Manke ..... E21B 17/06 166/242.7
2014/0060837 A1 * 3/2014 Love ..... E21B 43/26 166/297

* cited by examiner

*Primary Examiner* — Catherine Loikith
(74) *Attorney, Agent, or Firm* — Tai W. Nahm; Miller Thomson, LLP

(57) ABSTRACT

An improved frac plug apparatus and method for setting a plug in a downhole. In an embodiment, the apparatus comprises an inner cone shaped member having a first end and a second end, the inner cone shaped member having a generally increasing outer diameter from the first end, and an expandable outer sleeve having a first end and a second end, the first end of the expandable outer sleeve adapted to receive the first end of the inner cone shaped member and the second end of the expandable outer sleeve having a plurality of fingers joined at their tips at predetermined break points. In use, upon receiving the first end of the inner cone shaped member further into the expandable outer sleeve, the fingers of the expandable outer sleeve are adapted to break at their tips at their predetermined break points and expand outwardly to engage a surface of the downhole.

21 Claims, 9 Drawing Sheets

400

FRAC PLUG APPARATUS, SETTING TOOL, AND METHOD

FIELD OF THE INVENTION

The present invention relates generally to a plug apparatus, a setting tool, and method for use in hydraulic fracturing (fracking) applications.

BACKGROUND

Hydraulic fracturing, also commonly known as "fracking", is a technique used in oil and gas recovery from natural, subterranean reservoirs. The technique involves drilling a tubular borehole or wellbore into the ground to a sufficient depth to reach the subterranean oil and gas reservoirs. After reaching a desired depth, the borehole may optionally be drilled along a curve and then continue to run horizontally along a layer of an oil/gas bearing formation.

After a casing is set to secure the walls of the wellbore, a plug apparatus is run into the wellbore, and set at a desired location along the wellbore. A fracking fluid comprising water, a suitable proppant (such as sand grains, metal pellets, or other material) suspended in the water, and various chemicals are injected into the wellbore under high-pressure, and the pressure is applied at the location of the wellbore to create fractures in the surrounding oil/gas bearing formation. The proppant is deposited into the newly created fractures to prop them open, allowing the oil or gas in the formation to be released and collected at a well head.

During a fracking operation, multiple plugs may be set in sequence at multiple locations or zones along the wellbore. After a first zone has been fractured and the surrounding oil or gas extracted, the plug apparatus is drilled out such that another plug can be set in the wellhole, and fracking can occur in another zone.

The performance of the plug apparatus becomes significant to the overall efficiency and performance of the well, as the faster and more effectively a frac plug can be positioned and set, and the faster well can be put on production after use, the more efficient the extraction operation and the better the performance of the oil or gas well. While various frac plug designs have been proposed and designed that can effectively plug a wellbore for a fracking operation, the same frac plug designs may suffer from disadvantages as they may be difficult to mill out after the fracking operation or may have small inside diameters. Lengthy delays may be introduced due to need to mill out or restrict production flow rates using these prior art plugs.

Therefore, what is needed is an improved frac plug design which improves fracking efficiency and performance in comparison to the prior art.

SUMMARY

The present disclosure relates to an improved frac plug apparatus with a larger inside diameter which provides a more effective and efficient design for setting the plug at a desired location in the wellbore, and for subsequently removing the plug.

In an embodiment, the frac plug comprises an expandable outer sleeve, and a corresponding inner cone shaped member configured to be positioned inside the outer sleeve at a first end.

At the first end, an inner wall of the outer sleeve includes a slot for receiving a retaining ring. The retaining ring is also received in a corresponding slot formed on an outer wall of the inner cone shaped member, such that the expandable outer ring and inner cone shaped member are positioned at an initial position.

At a second end, the outer sleeve comprises a plurality of fingers formed by slits cut out substantially parallel to the length of the outer sleeve. In a preferred embodiment, the ends of the fingers are joined at a break point designed to break and allow the fingers to break apart at the second end. The base of the plurality of fingers may include a rounded cutout to reduce the chance of a fracture occurring at the base of the fingers.

In a preferred embodiment, an outer surface of the plurality of fingers have sharply angled wickers or inserts designed to engage and grip a casing wall or wellbore wall at a desired plug location.

In a preferred embodiment, an inner surface of the plurality of fingers have a progressively narrowing profile to engage and outer surface of the inner cone shaped member when the inner cone shaped member is inserted sufficiently.

In use, the frac plug is lowered into a wellbore while in the initial position as described above. The frac plug is then positioned at a desired location along the wellbore at which the frac plug is to be set. At the desired location, the inner cone shaped member is impacted and driven in with sufficient force such that the inner cone shaped member is forced into the expandable outer sleeve, shortening the overall length of the frac plug from the initial position. At the same time, the outer profile of the inner cone shaped member forces the fingers of the expandable outer sleeve to break apart at their break points, and spread out to grip the walls of a casing or wellbore with greater force.

Once the inner cone shaped member is inserted into the expandable outer sleeve, and the fingers of the expandable outer sleeve have securely gripped the walls of the casing or wellbore wall, a ball is dropped into the free end of the inner cone shaped member to hydraulically seal the frac plug.

In an embodiment, the inner cone shaped member and expandable outer sleeve are both made of a dissolvable material, such that milling the frac plug after use becomes unnecessary. The ball may also be made from a dissolvable material which disintegrates after a period of use, typically measured in tens of hours or a few days. Advantageously, by making all parts of the frac plug dissolvable, milling out the plug becomes unnecessary.

In this respect, before explaining at least one embodiment of the invention in detail, it is to be understood that the invention is not limited in its applications to the details of construction and to the arrangements of the components set forth in the following description or the examples provided therein, or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

As noted above, the present disclosure relates to an improved frac plug apparatus which provides a more effective and efficient design for setting the plug at a desired location in the wellbore, and for subsequently removing the plug.

Illustrative embodiments will now be described with reference to the drawings.

Figure 1:
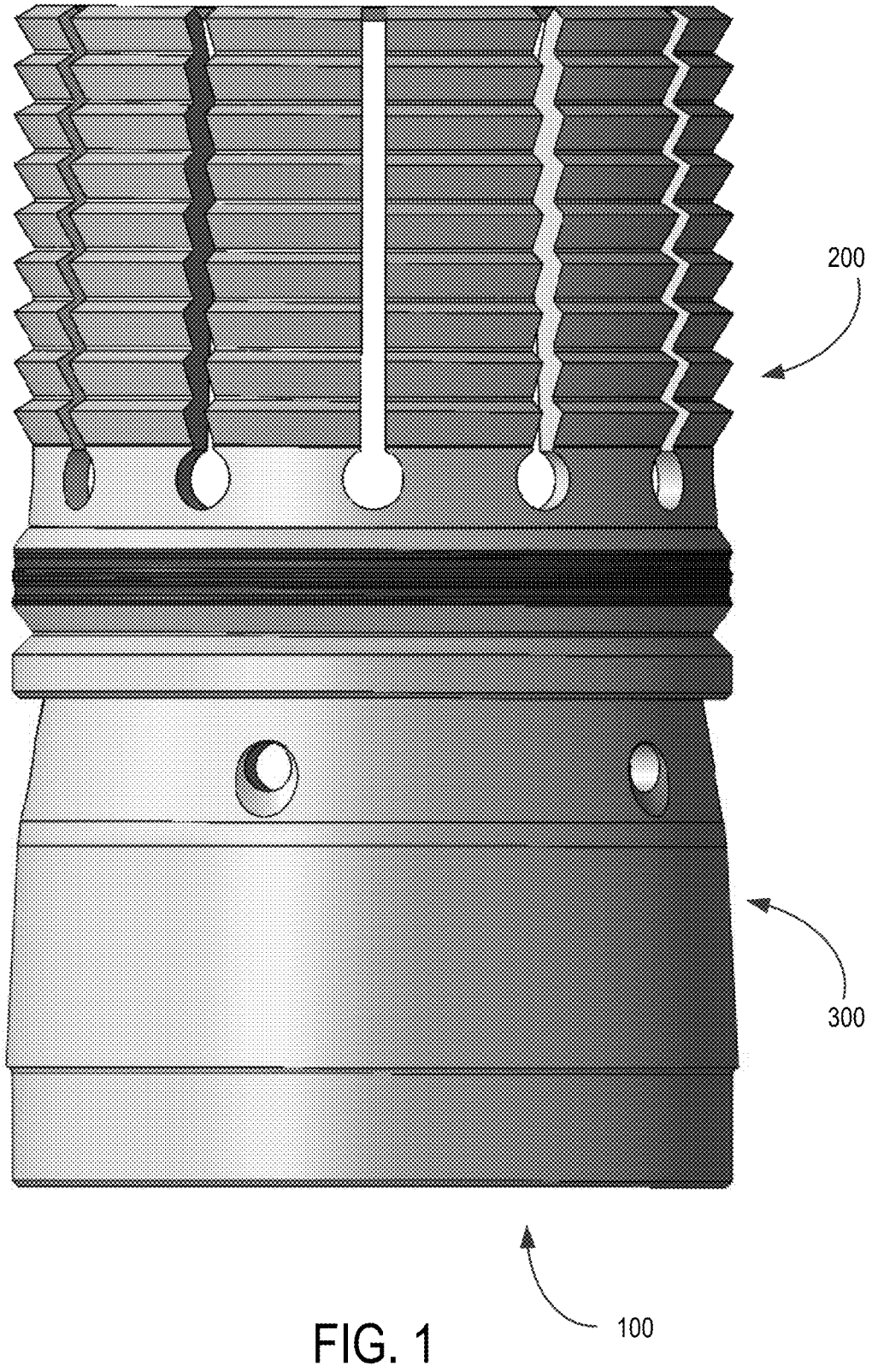
FIG. 1 shows a plan view of a frac plug comprising an expandable outer sleeve and an inner cone shaped member in accordance with an illustrative embodiment.
Figure 2:
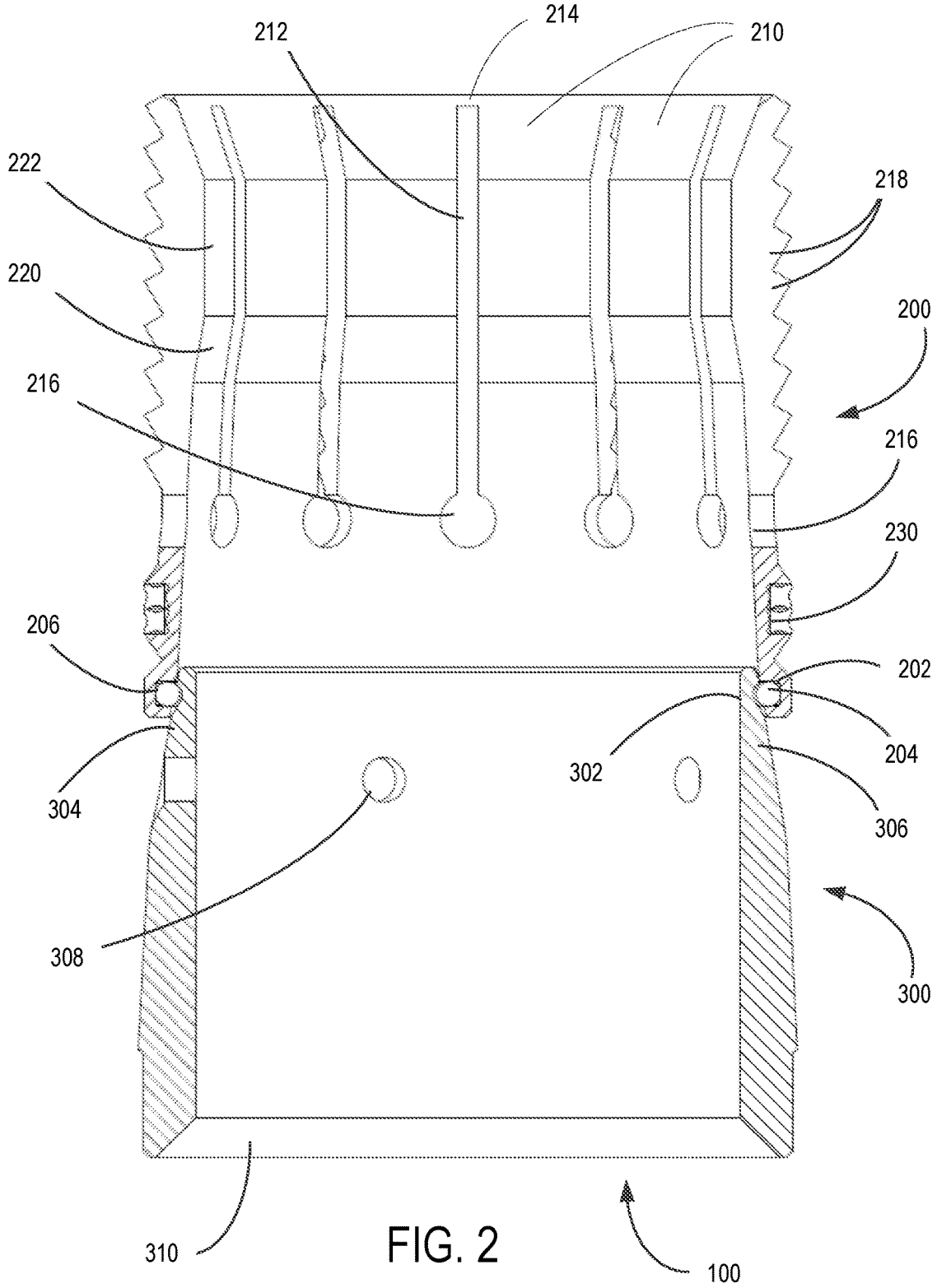
FIG. 2 shows a cross-sectional view of the frac plug of FIG. 1 in accordance with an illustrative embodiment.

Referring to FIG. 1, shown is a plan view of a frac plug apparatus 100 comprising an expandable outer sleeve 200 and an inner cone shaped member 300 in accordance with an illustrative embodiment. FIG. 2 shows a corresponding cross-sectional view of the frac plug of FIG. 1 in accordance with an illustrative embodiment.

As shown best in FIG. 2, in an embodiment, expandable outer sleeve 200 is configured to receive a corresponding inner cone shaped member 300 positioned inside the expandable outer sleeve 200 at a first end 202. At the first end 202, an inner wall of the outer sleeve includes a slot 204 for receiving a retaining ring 206. The retaining ring 206 is also received in a corresponding slot 302 formed on an outer wall at a first end 304 of the inner cone shaped member, such that the expandable outer sleeve 200 and inner cone shaped member 300 are positioned at an initial position shown in FIG. 2.

Still referring to FIG. 2, the expandable outer sleeve 200 comprises a plurality of fingers 210 formed by slits 212 cut out substantially parallel along the length of the expandable outer sleeve 200. In a preferred embodiment, the ends of the fingers 210 are joined at a break point 214 at a second end, designed to allow the fingers to break apart at their outer edges along the second end. The base of the plurality of fingers may include a relief 216 to reduce the chance of a fracture occurring at the base of the fingers.

In a preferred embodiment, an outer surface of the plurality of fingers have sharply angled threads or wickers 218 (or alternatively buttons) designed to engage and grip a casing wall or wellbore wall (not shown) at a desired plug location.

In a preferred embodiment, an inner surface 220, 222 of each of the plurality of fingers 210 has a progressively thicker profile along at least a portion of the length of the fingers 210 to engage an outer surface 306 of the inner cone shaped member 300, when the inner cone shaped member 300 is inserted sufficiently into the expandable outer sleeve 200.

In an embodiment, the inner cone shaped member 300 includes a beveled seat 310 at a second end which is suitably shaped to receive a ball (see FIGS. 6A to 6C further below). The inner cone shaped member 300 may also have a plurality of apertures 308 near the leading edge of the inner cone shaped members 300 to allow for flow back should the inside diameter of the leading edge become blocked or restricted.

Still referring to FIG. 2, in an embodiment, the expandable outer sleeve 200 includes an outer seal encircling an outer wall near the first end 202 of the expandable outer sleeve 200.

In use, the frac plug 100 is lowered into a wellbore while in the initial position as shown in FIG. 2 and as described above. The frac plug 100 is positioned at a desired location along the wellbore at which the frac plug 100 is to be set. At the desired position, the inner cone shaped member 300 is inserted into the expandable outer sleeve 200 utilizing a setting tool as illustrated by way of example in FIGS. 7A to 7C.

Figure 3:
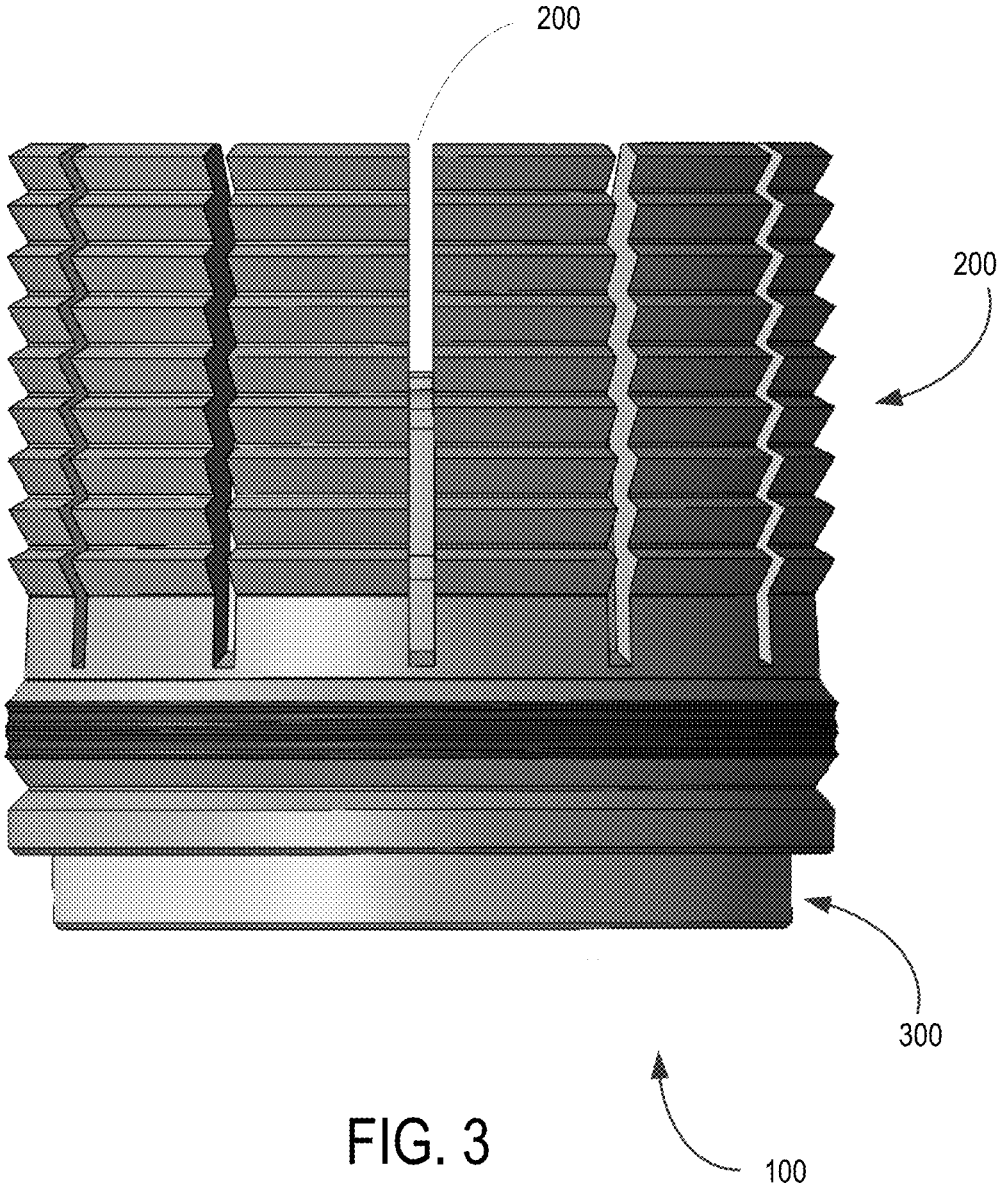
FIG. 3 shows a plan view of a frac plug in accordance with another illustrative embodiment, in which the inner cone shaped member is inserted into the expandable outer sleeve.
Figure 4:
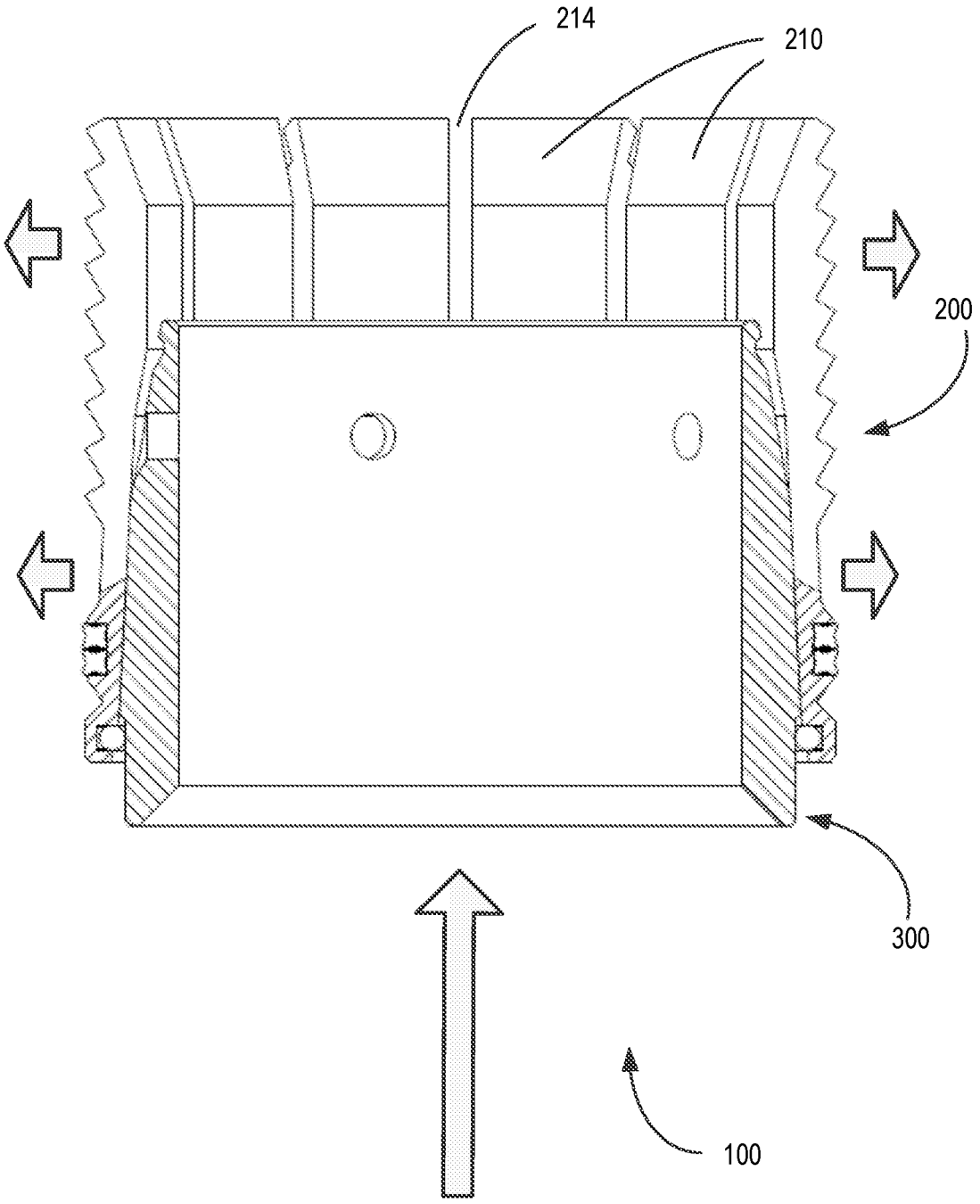
FIG. 4 shows a cross-sectional view of the frac plug of FIG. 3 in accordance with an embodiment.

Referring to FIG. 3, shown is a plan view of a frac plug in accordance with another illustrative embodiment, in which the inner cone shaped member 300 is inserted into the expandable outer sleeve 200 utilizing a setting tool (e.g. see setting tool 400 of FIGS. 7A to 7C below). FIG. 4 shows a cross-sectional view of the frac plug of FIG. 3 in accordance with an embodiment.

As best shown in FIG. 4, at the desired location, the inner cone shaped member 300 is impacted and driven in with sufficient force such that the inner cone shaped member 300 is forced into the expandable outer sleeve 200, significantly shortening the overall length of the frac plug 100 from the initial position shown in FIG. 2. At the same time as the inner cone shaped member 300 is wedged into the expandable outer sleeve 200 using setting tool 400, the fingers 210 of the expandable outer sleeve 200 break apart at their break points 214 and spread outwardly on all sides to grip the walls of a casing or wellbore (not shown) with greater force. The further the inner cone shaped member 300 is driven into the expandable outer sleeve 200 by the setting tool 400, the greater the expansion of the expandable outer sleeve 200.

As the expandable outer sleeve 200 expands, the seal 230 encircling the outer wall of the expandable outer sleeve 200 engages the wall of a casing or wellbore (not shown) to achieve a hydraulic seal. At the same time, each of the fingers 210 are forced to grip the walls more tightly, as narrower sections of the inner walls 220, 222 of the fingers 210 engage the wall of the casing or wellbore.

Figure 5A:
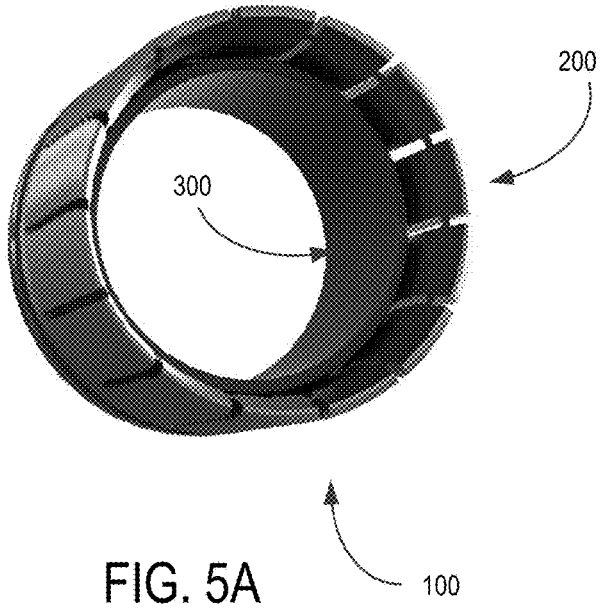
FIG. 5A shows an illustrative perspective view of the frac plug in accordance with another illustrative embodiment, showing the inner cone shaped member inserted into the expandable outer sleeve.
Figure 5B:
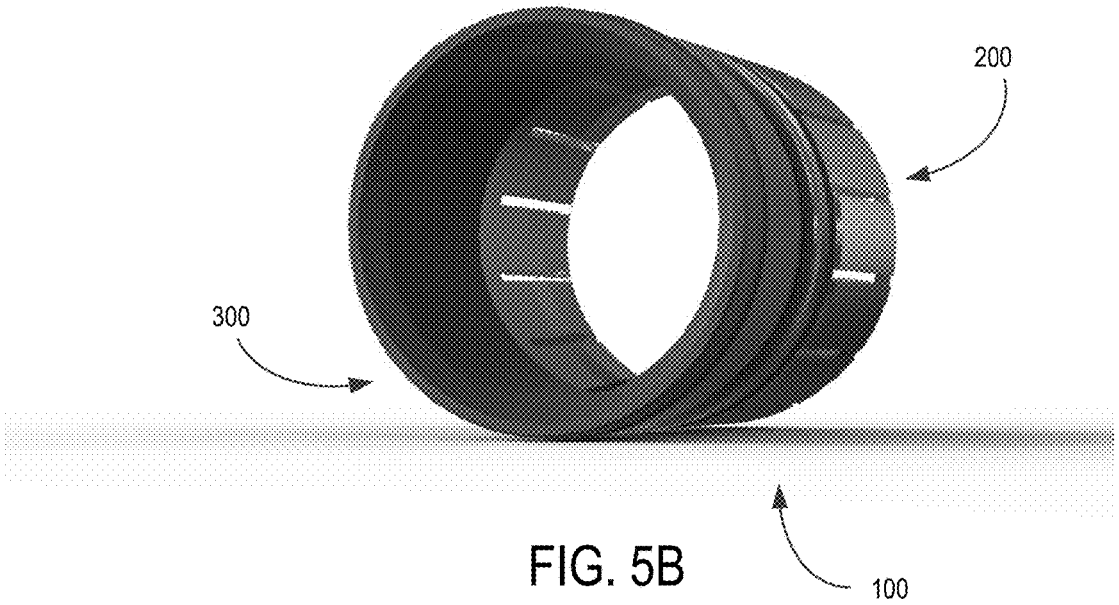
FIG. 5B shows an illustrative perspective of the frac plug in accordance with another illustrative embodiment, showing the inner cone shaped member of FIG. 5A before insertion into the expandable outer sleeve.

In a perspective view, FIG. 5A shows the frac plug 100 before insertion of the inner cone shaped member 300 into the expandable outer sleeve 200. FIG. 5B show a corresponding perspective view of the frac plug 100 when the inner cone shaped member 300 is substantially inserted into the expandable outer sleeve 200.

Figure 6A:
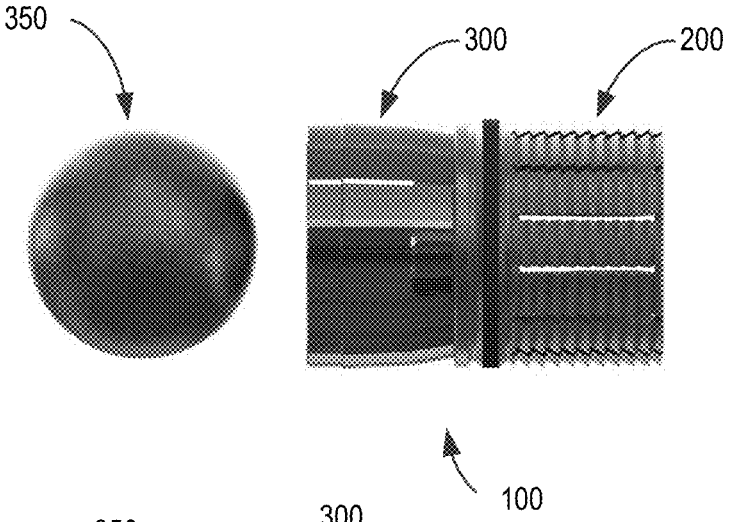
FIGS. 6A to 6C show an illustrative sequence of a frac plug in accordance with an embodiment of the invention, in which a ball is seated into an end of the inner cone shaped member, and the inner cone shaped member is inserted into the expandable outer sleeve.
Figure 6B:
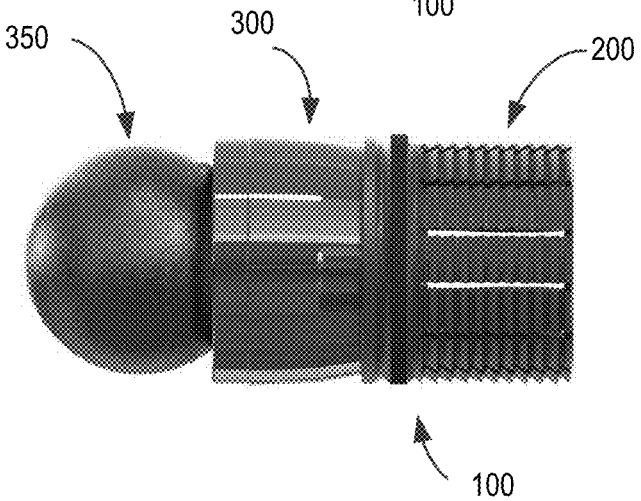
Figure 6C:
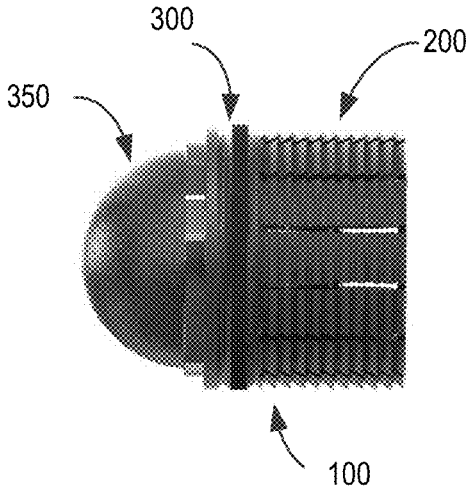

FIGS. 6A to 6C show an illustrative sequence of a frac plug 100 in accordance with an embodiment, in which a ball 350 is seated into an end of the inner cone shaped member 300, and the inner cone shaped member 300 is in turn inserted into the expandable outer sleeve 200. FIG. 6A shows the frac plug 100 in an initial position, FIG. 6B shows an intermediate position in which the ball 350 is about to be seated, and FIG. 6C shows the inner cone shaped member 300 substantially fully inserted into the expandable outer sleeve. In use, the ball is dropped into the seat after the plug has been set with a setting tool.

Figure 7A:
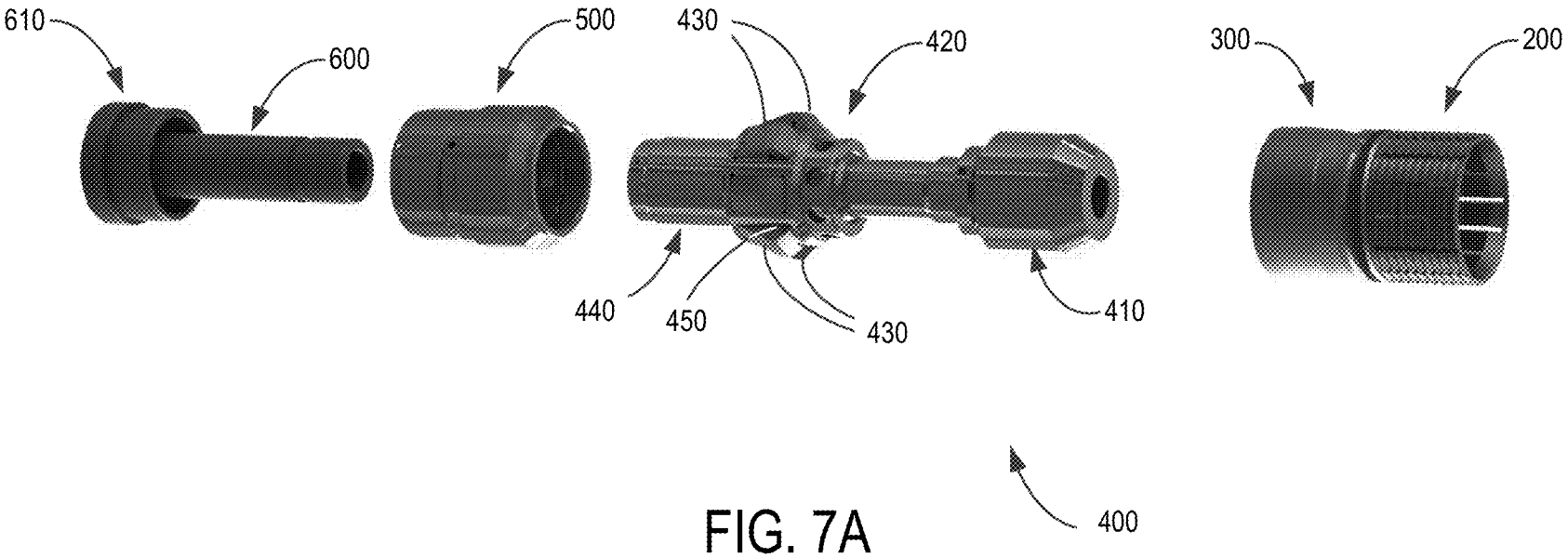
FIGS. 7A to 7C show an illustrative setting tool for loading and setting the frac plug of FIGS. 1 to 5B.
Figure 7B:
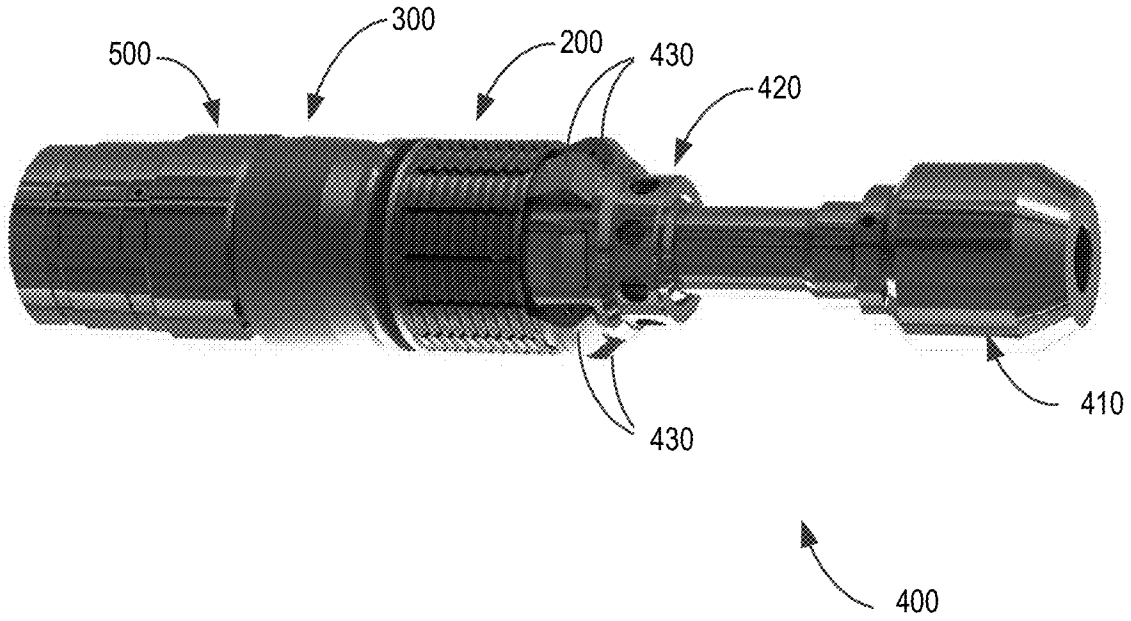
Figure 7C:
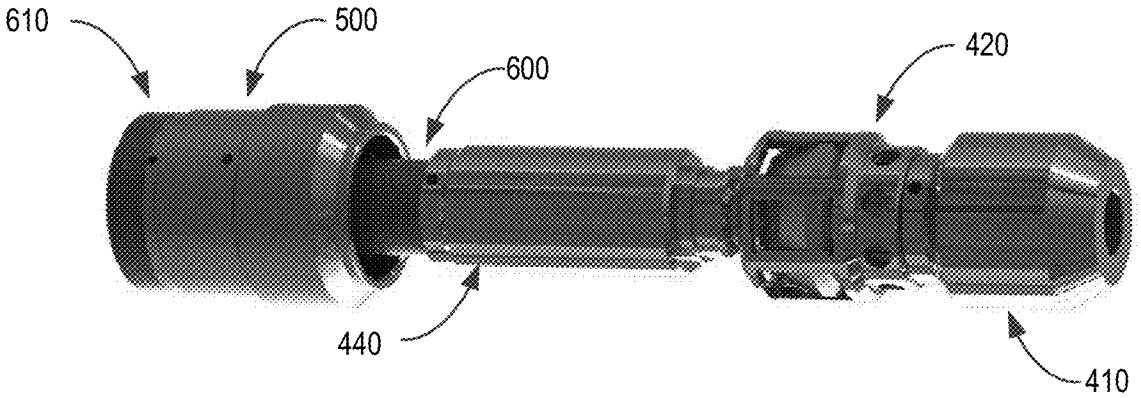

Now referring to FIGS. 7A to 7C, shown is an illustrative setting tool 400 for positioning and setting the frac plug apparatus 100 described above. In FIG. 7A, an inner cone shaped member 300 and an expandable outer sleeve 200 are shown to the right. Moving from right to left, shown is a bottom sub 410 having a generally elongate shape. An outer ring cage 420 including a plurality of setting tabs 430 is adapted to slide along a length of mandrel 440. The setting dogs or tabs 430 are held in position as shown in FIG. 7A by the outside diameter of the mandrel 440, outer ring cage 420, and shear pins 450. As will be described in further detail below, the setting tabs 430 are adapted to abut the fingers 210 of the expandable outer sleeve 200 as the frac plug 100 is set.

Still referring to FIG. 7A, shown to the left of the bottom sub 410 is a setting sleeve 500 which, in use, engages an end of the inner cone shaped member 300 to urge the inner cone shaped member 300 into expandable outer sleeve 200. An adapter 600 provided at the end of the setting tool may be extended through setting sleeve 500 and screwed into the top of mandrel 440. Cap 610 of adapter 600 retains the setting sleeve 500 in the setting tool assembly.

Now referring to FIG. 7B, shown is the illustrative setting tool 400 of FIG. 7A in an assembled "run-in" position with the inner cone shaped member 300 into expandable outer sleeve 200 mounted over bottom sub 410. As shown, setting sleeve 500 engages inner cone shaped member 300 to the left, and tabs 430 engage the expandable outer sleeve 200 to the right. The setting tool 400 is run into a downhole in this assembled state, until the frac plug reaches the desired position.

At the desired position, The adapter 600 and setting sleeve 500 are urged against inner cone shaped member 300 to drive the inner cone shaped member into the expandable outer sleeve 200. As the inner cone shaped member 300 is inserted into the expandable outer sleeve 200, and the fingers 210 of the expandable outer sleeve 200 break at their predetermined break points 214 and expand outwardly until the fingers 210 have securely gripped the walls of the casing or wellbore wall with their wickers 218. At this point, as shown in FIG. 7C, the shear pins 450 have sheared, the outer ring cage 420 has slid down the mandrel 440, the tabs 430 are no longer supported by the shear pins 450, allowing them to collapse into the outer ring cage 420, thereby allowing the setting tool 400 to be withdrawn through the set frac plug 100.

Once the setting tool is withdrawn, a ball 350 is dropped into the downhole to be received into an end of the inner cone shaped member 300 as shown in FIG. 6C, and to hydraulically seal the set frac plug 100.

In an embodiment, the inner cone shaped member 300 and expandable outer sleeve 200 are made of a dissolvable material, such that milling the frac plug after use becomes unnecessary. This component may alternatively be metallic or non-metallic. In some other embodiments the expandable outer sleeve may also be a dissolvable material, or alternatively a metallic or non-metallic material.

The ball 350 may also be made from a dissolvable material which disintegrates after a period of use, typically measured in tens of hours or a few days.

In an illustrative configuration, the frac plug 100 is available in different sizes to handle larger wellhole diameters, such as 4½ inch or 5½ inch casing sizes. Once properly set in position, and the frac plug 100 is hydraulically sealed with a properly seated ball 350, the frac plug 100 is capable of withstanding 10,000 psi or more.

Advantageously, the frac plug 100 of the present invention is mechanically simple, comprising just three main components to achieve a hydraulic seal. As well, by making one or more of the frac plug 100 dissolvable, milling out the plug becomes unnecessary or may be significantly reduced.

Thus, in an aspect, there is provided a frac plug apparatus for a downhole, comprising: an inner cone shaped member having a first end and a second end, the inner cone shaped member having a generally increasing outer diameter from the first end; an expandable outer sleeve having a first end and a second end, the first end of the expandable outer sleeve adapted to receive the first end of the inner cone shaped member and the second end of the expandable outer sleeve having a plurality of fingers joined at their tips at predetermined break points; wherein, upon receiving the first end of the inner cone shaped member further into the expandable outer sleeve, the fingers of the expandable outer sleeve are adapted to break at their tips at their predetermined break points and expand outwardly to engage a surface of the downhole.

In an embodiment, the inner cone shaped member and the expandable outer sleeve are engaged at their respective first ends via a retaining ring seated in respective grooves formed in the inner cone shaped member and the expandable outer sleeve.

In another embodiment, the expandable outer sleeve includes one or more seals encircling an outer wall of the expandable outer sleeve near the first end of the expandable outer sleeve, the one or more seals adapted to engage a wall of the downhole.

In another embodiment, the one or more seals are seated in a groove formed in an outer wall near the first end of the expandable outer sleeve.

In another embodiment, the expandable outer sleeve is adapted to increase in diameter as the expandable outer sleeve receives the inner cone shaped member further into the expandable outer sleeve.

In another embodiment, the plurality of fingers of the expandable outer sleeve include threads, wickers or buttons formed on their outer surfaces.

In another embodiment, the threads, wickers or buttons formed on the outer surfaces of the fingers are angled to prevent further travel of the expandable outer sleeve along the downhole.

In another embodiment, the plurality of fingers of the expandable outer sleeve have at least one section having a thicker wall, whereby the plurality of fingers form a narrower inner diameter.

In another embodiment, the narrower inner diameter formed by the at least one section of the plurality of fingers are adapted to receive the first end of the inner cone shaped member, and to expand the plurality of fingers further outwardly as the outer surface of the inner cone shaped member engages the at least one section of the plurality of fingers forming the narrower inner diameter.

In another embodiment, the plurality of fingers of the expandable outer sleeve include a relief at a base formed between each of the plurality of fingers, the relief adapted to prevent tearing at the base as the plurality of fingers break at their tips at their predetermined break points and expand outwardly to engage a surface of the downhole.

In another embodiment, the inner cone shaped member further comprises a plurality of flow back apertures located near the first end of the inner cone shaped member.

In another embodiment, the second end of the inner cone shaped member includes a beveled seat.

In another embodiment, the frac plug apparatus further comprises a ball having a diameter suitable for being received in the beveled seat at the second end of the inner cone shaped member.

In another embodiment, the inner cone shaped member and the expandable outer sleeve are engaged at their respective first ends and form an inner diameter sufficient to allow at least a portion of a setting tool to pass therethrough.

In another aspect, there is provided a setting tool for setting a frac plug apparatus the setting tool comprising: a generally elongate mandrel; an outer ring cage slidably engaged on the mandrel, the outer ring cage adapted to position a plurality of setting tabs in a circular arrangement to engage a frac plug loaded onto the setting tool; a setting sleeve for engaging an opposite end of the frac plug loaded onto the setting tool; and an adapter for retaining the setting sleeve on the setting tool for a downhole run.

In an embodiment, the frac plug loaded onto the setting tool comprises: an inner cone shaped member having a first end and a second end, the inner cone shaped member having a generally increasing outer diameter from the first end; and an expandable outer sleeve having a first end and a second end, the first end of the expandable outer sleeve adapted to receive the first end of the inner cone shaped member and the second end of the expandable outer sleeve having a plurality of fingers joined at their tips at predetermined break points.

In another embodiment, the setting sleeve is adapted to engage the second end of the inner cone shaped member of the frac plug, and the plurality of setting tabs in a circular arrangement are adapted to engage the second end of the expandable outer sleeve of the frac plug.

In another embodiment, upon urging the setting sleeve of the setting tool to push the first end of the inner cone shaped member further into the expandable outer sleeve, the fingers of the expandable outer sleeve are adapted to break at their tips at their predetermined break points and expand outwardly as the plurality of fingers are pushed against the plurality of setting tabs in a circular arrangement.

In another embodiment, upon completion of setting the frac plug, the plurality of setting tabs are adapted to collapse into the outer ring cage, thereby to decrease the outer diameter formed by the plurality of setting tabs.

In another embodiment, upon completion of setting the frac plug, the setting tool is adapted to be retrieved through the set frac plug.

In another aspect, there is provided a method of setting a frac plug apparatus in a downhole using a setting tool, comprising: loading a frac plug apparatus onto a setting tool, the frac plug apparatus comprising: an inner cone shaped member having a first end and a second end, the inner cone shaped member having a generally increasing outer diameter from the first end; and an expandable outer sleeve having a first end and a second end, the first end of the expandable outer sleeve adapted to receive the first end of the inner cone shaped member and the second end of the expandable outer sleeve having a plurality of fingers joined at their tips at predetermined break points; running the setting tool loaded with the frac plug apparatus into the downhole; at a desired location, pushing the inner cone shaped member into the expandable outer sleeve until the fingers of the expandable outer sleeve break at their tips at their predetermined break points and expand outwardly to engage walls of the downhole; and withdrawing the setting tool through the set frac plug.

While illustrative embodiments have been described above by way of example, it will be appreciated that various changes and modifications may be made without departing from the scope of the invention, which is defined by the following claims.

The invention claimed is:

1. A frac plug apparatus for a downhole, comprising:

an inner cone shaped member having a first end and a second end, the inner cone shaped member having a generally increasing outer diameter from the first end; and an expandable outer sleeve having a first end and a second end, the first end of the expandable outer sleeve adapted to receive the first end of the inner cone shaped member and the second end of the expandable outer sleeve having a plurality of fingers joined at their tips at predetermined break points;

wherein, upon receiving the first end of the inner cone shaped member further into the expandable outer sleeve, the fingers of the expandable outer sleeve are adapted to break at their tips at their predetermined break points and expand outwardly to engage a surface of the downhole.

2. The frac plug apparatus of claim 1, wherein, the inner cone shaped member and the expandable outer sleeve are engaged at their respective first ends via a retaining ring seated in respective grooves formed in the inner cone shaped member and the expandable outer sleeve.

3. The frac plug apparatus of claim 2, wherein the inner cone shaped member and the expandable outer sleeve are engaged at their respective first ends and form an inner diameter sufficient to allow at least a portion of a setting tool to pass therethrough.

4. The frac plug apparatus of claim 1, wherein, the expandable outer sleeve includes one or more seals encircling an outer wall of the expandable outer sleeve near the first end of the expandable outer sleeve, the one or more seals adapted to engage a wall of the downhole.

5. The frac plug apparatus of claim 4, wherein the one or more seals are seated in a groove formed in an outer wall near the first end of the expandable outer sleeve.

6. The frac plug apparatus of claim 1, wherein the expandable outer sleeve is adapted to increase in diameter as the expandable outer sleeve receives the inner cone shaped member further into the expandable outer sleeve.

7. The frac plug apparatus of claim 1, wherein, the plurality of fingers of the expandable outer sleeve include threads, wickers or buttons formed on their outer surfaces.

8. The frac plug apparatus of claim 1, wherein, the threads, wickers or buttons formed on outer surfaces of the fingers are angled to prevent further travel of the expandable outer sleeve along the downhole.

9. The frac plug apparatus of claim 8, wherein, the narrower inner diameter formed by the at least one section of the plurality of fingers are adapted to receive the first end of the inner cone shaped member, and to expand the plurality of fingers further outwardly as the outer surface of the inner cone shaped member engages the at least one section of the plurality of fingers forming the narrower inner diameter.

10. The frac plug apparatus of claim 1, wherein, the plurality of fingers of the expandable outer sleeve have at least one section having a thicker wall, whereby the plurality of fingers form a narrower inner diameter.

11. The frac plug apparatus of claim 1, wherein the plurality of fingers of the expandable outer sleeve include a relief at a base formed between each of the plurality of fingers, the relief adapted to prevent tearing at the base as the plurality of fingers break at their tips at their predetermined break points and expand outwardly to engage a surface of the downhole.

12. The frac plug apparatus of claim 1, wherein the inner cone shaped member further comprises a plurality of flow back apertures located near the first end of the inner cone shaped member.

13. The frac plug apparatus of claim 1, wherein the second end of the inner cone shaped member includes a beveled seat.

14. The frac plug apparatus of claim 13, further comprising a ball having a diameter suitable for being received in the beveled seat at the second end of the inner cone shaped member.

15. A setting tool for setting a frac plug apparatus the setting tool comprising:

a generally elongate mandrel;

an outer ring cage slidably engaged on the mandrel, the outer ring cage adapted to position a plurality of setting tabs in a circular arrangement to engage a frac plug loaded onto the setting tool;

a setting sleeve for engaging an opposite end of the frac plug loaded onto the setting tool; and an adapter for retaining the setting sleeve on the setting tool for a downhole run.

16. The setting tool of claim 15, wherein the frac plug loaded onto the setting tool comprises:

an inner cone shaped member having a first end and a second end, the inner cone shaped member having a generally increasing outer diameter from the first end; and an expandable outer sleeve having a first end and a second end, the first end of the expandable outer sleeve adapted to receive the first end of the inner cone shaped member and the second end of the expandable outer sleeve having a plurality of fingers joined at their tips at predetermined breakpoints.

17. The setting tool of claim 16, wherein, the setting sleeve is adapted to engage the second end of the inner cone shaped member of the frac plug, and the plurality of setting tabs in a circular arrangement are adapted to engage the second end of the expandable outer sleeve of the frac plug.

18. The setting tool of claim 17, wherein, upon urging the setting sleeve of the setting tool to push the first end of the inner cone shaped member further into the expandable outer sleeve, the fingers of the expandable outer sleeve are adapted to break at their tips at their predetermined break points and expand outwardly as the plurality of fingers are pushed against the plurality of setting tabs in a circular arrangement.

19. The setting tool of claim 17, wherein, upon completion of setting the frac plug, the plurality of setting tabs are adapted to collapse into the outer ring cage, thereby to decrease an outer diameter formed by the plurality of setting tabs.

20. The setting tool of claim 17, wherein, upon completion of setting the frac plug, the setting tool is adapted to be retrieved through the set frac plug.

21. A method of setting a frac plug apparatus in a downhole using a setting tool, comprising:

loading a frac plug apparatus onto a setting tool, the frac plug apparatus comprising:

an inner cone shaped member having a first end and a second end, the inner cone shaped member having a generally increasing outer diameter from the first end; and an expandable outer sleeve having a first end and a second end, the first end of the expandable outer sleeve adapted to receive the first end of the inner cone shaped member and the second end of the expandable outer sleeve having a plurality of fingers joined at their tips at predetermined break points;

running the setting tool loaded with the frac plug apparatus into the downhole;

at a desired location, pushing the inner cone shaped member into the expandable outer sleeve until the fingers of the expandable outer sleeve break at their tips at their predetermined break points and expand outwardly to engage walls of the downhole; and withdrawing the setting tool through the set frac plug.

* * * * *